US011274826B2

(12) United States Patent
Billman et al.

(10) Patent No.: US 11,274,826 B2
(45) Date of Patent: Mar. 15, 2022

(54) DELAYED IGNITION PREVENTION IN A MULTI-RING GAS BURNER FOR A COOKTOP APPLIANCE

(71) Applicant: Haier US Appliance Solutions, Inc., Wilmington, DE (US)

(72) Inventors: David William Billman, Louisville, KY (US); Jennifer Nicole Lea, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 202 days.

(21) Appl. No.: 16/592,029

(22) Filed: Oct. 3, 2019

(65) Prior Publication Data

US 2021/0102700 A1 Apr. 8, 2021

(51) Int. Cl.

| | |
|---|---|
| ***F23K 5/00*** | (2006.01) |
| ***F23N 1/00*** | (2006.01) |
| ***F24C 3/12*** | (2006.01) |

(52) U.S. Cl.

CPC ..... *F23N 1/005* (2013.01); *F23K 5/005* (2013.01); *F24C 3/126* (2013.01); *F23D 2900/14062* (2013.01); *F23N 2229/00* (2020.01); *F23N 2235/14* (2020.01); *F23N 2241/08* (2020.01)

(58) Field of Classification Search

CPC .. F23N 1/005; F23N 2241/08; F23N 2229/00; F23N 2235/14; F23K 5/005; F24C 3/126

USPC ..... 126/380.1, 350.2; 431/194, 54, 154

See application file for complete search history.

(56) References Cited

U.S. PATENT DOCUMENTS

| | | | | |
|---|---|---|---|---|
| 4,887,959 | A * | 12/1989 | Shellenberger | F23Q 7/26 431/46 |
| 5,941,236 | A * | 8/1999 | Byrne | F23D 14/725 126/343.5 A |
| 6,132,205 | A | 10/2000 | Harneit | |
| 2014/0238384 | A1* | 8/2014 | Cadima | F23D 14/06 126/39 E |
| 2016/0084506 | A1* | 3/2016 | Rickert | F24C 3/126 126/42 |

FOREIGN PATENT DOCUMENTS

| | | | |
|---|---|---|---|
| CN | 2249865 | Y | 3/1997 |
| WO | WO2012099474 | A1 | 7/2012 |

* cited by examiner

*Primary Examiner* — Avinash A Savani

(74) *Attorney, Agent, or Firm* — Dority & Manning, P.A.

(57) ABSTRACT

A method of operating a multi-ring gas burner includes sending a spark to a first ring of the multi-ring burner. After sending the spark to the first ring, the method determines a flame status of the first ring and adjusts a position of an electronic gas valve connected to a second ring of the multi-ring gas burner based on the determined flame status of the first ring.

10 Claims, 4 Drawing Sheets

DELAYED IGNITION PREVENTION IN A MULTI-RING GAS BURNER FOR A COOKTOP APPLIANCE

FIELD OF THE INVENTION

The present subject matter relates generally to cooktop appliances and gas burner assemblies for cooktop appliances.

BACKGROUND OF THE INVENTION

Generally, gas cooktop appliances include a plurality of gas burners mounted to a top surface of the appliance. Certain cooktop appliances include multi-ring gas burners. Such burners can include a center burner surrounded by one or more concentric burner rings. Certain multi-ring gas burners ignite gaseous fuel, such as propane or natural gas, at one of the burner rings and utilize carryover ducts to carry flames and ignite gaseous fuel at other burner rings.

Generally, carryover ducts suffer from certain problems. For example, each burner ring may have an independent gas supply, while the burner has a single igniter, such that the ignition of one burner ring is dependent on ignition in another ring and carryover of the flame from the ignited ring. When the gas flows are independent, a delayed ignition or lack of ignition in one ring may result in excessive fuel flow to another burner ring which is dependent on the one ring for ignition via the carryover duct.

Accordingly, a multi-ring gas burner with features for verifying or ensuring flame transfer between burners of the multi-ring gas burner would be useful.

BRIEF DESCRIPTION OF THE INVENTION

Aspects and advantages of the invention will be set forth in part in the following description, or may be apparent from the description, or may be learned through practice of the invention.

In a first exemplary embodiment, a method of operating a multi-ring gas burner is provided. The method includes sending a spark to a first ring of the multi-ring burner. After sending the spark to the first ring, the method determines a flame status of the first ring and adjusts a position of an electronic gas valve connected to a second ring of the multi-ring gas burner based on the determined flame status of the first ring.

In a second exemplary embodiment, a cooktop appliance is provided. The cooktop appliance includes a multi-ring gas burner comprising a first ring and a second ring. The multi-ring burner also includes an igniter in operative communication with the first ring to ignite fuel in the first ring and thereby initiate combustion in the first ring. The multi-ring burner further includes a carryover duct extending from the first ring to the second ring. The carryover duct permits combustion products, e.g., hot air and/or flames, generated in the first ring to ignite fuel from the second ring in the carryover duct, whereupon combustion products travel through the carryover duct and thereby initiate combustion in the second ring. The cooktop appliance also includes a first electronic gas valve connected to the first ring and a second electronic gas valve connected to the second ring. The cooktop appliance further includes a controller in operative communication with the igniter to detect a presence or an absence of combustion in the first ring. The controller is also in operative communication with the first electronic gas valve and the second electronic gas valve. The controller is configured for sending a spark to the first ring of the multi-ring burner via the igniter and determining a flame status of the first ring based on a signal from the igniter. The controller is also configured for adjusting a position of the second electronic gas valve connected to the second ring of the multi-ring gas burner based on the determined flame status of the first ring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
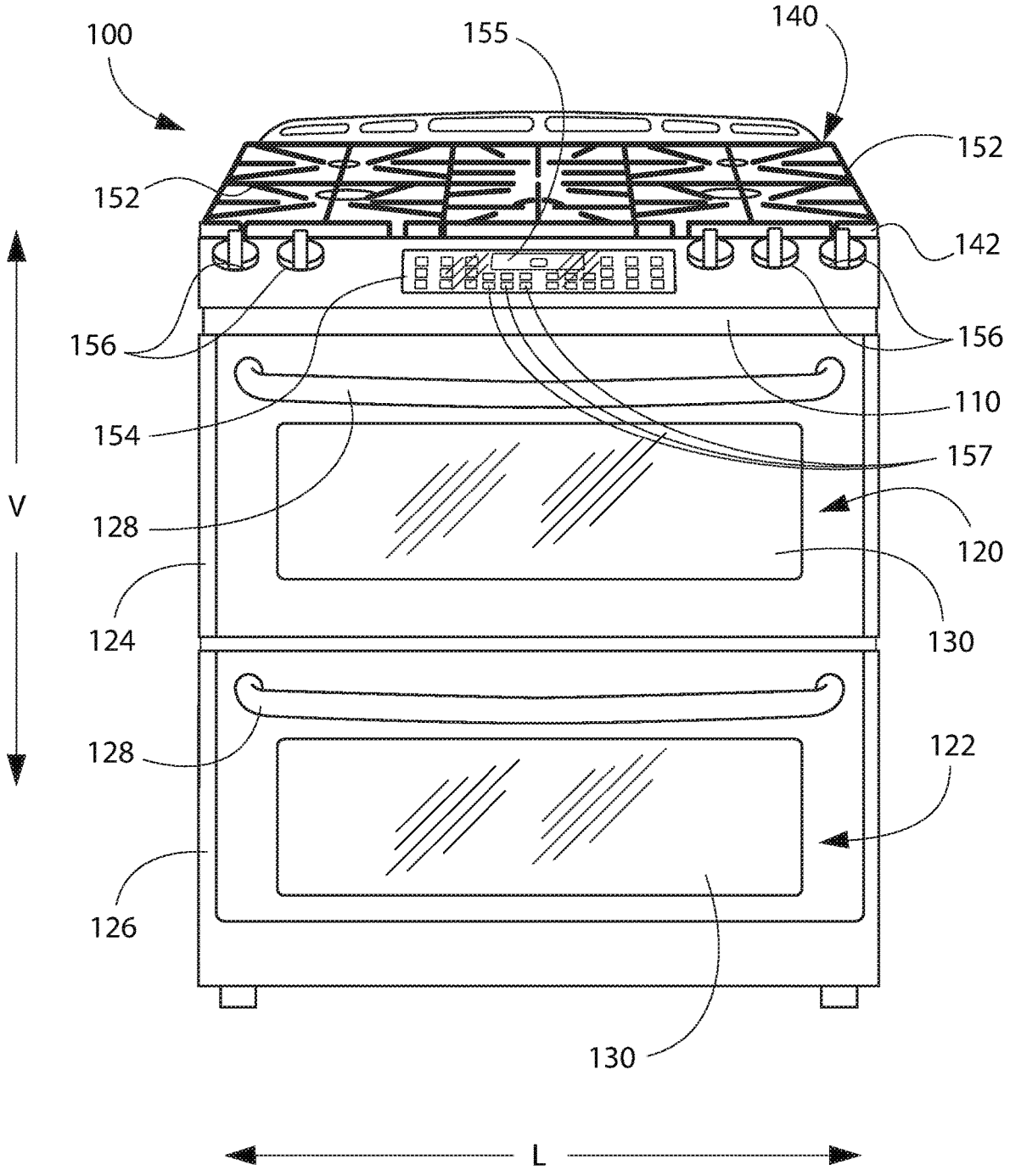
FIG. 1 provides a front, perspective view of a range appliance according to one or more example embodiments of the present subject matter.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. As used herein, the terms "first," "second," and "third" may be used interchangeably to distinguish one component from another and are not intended to signify location or importance of the individual components.

Figure 2:
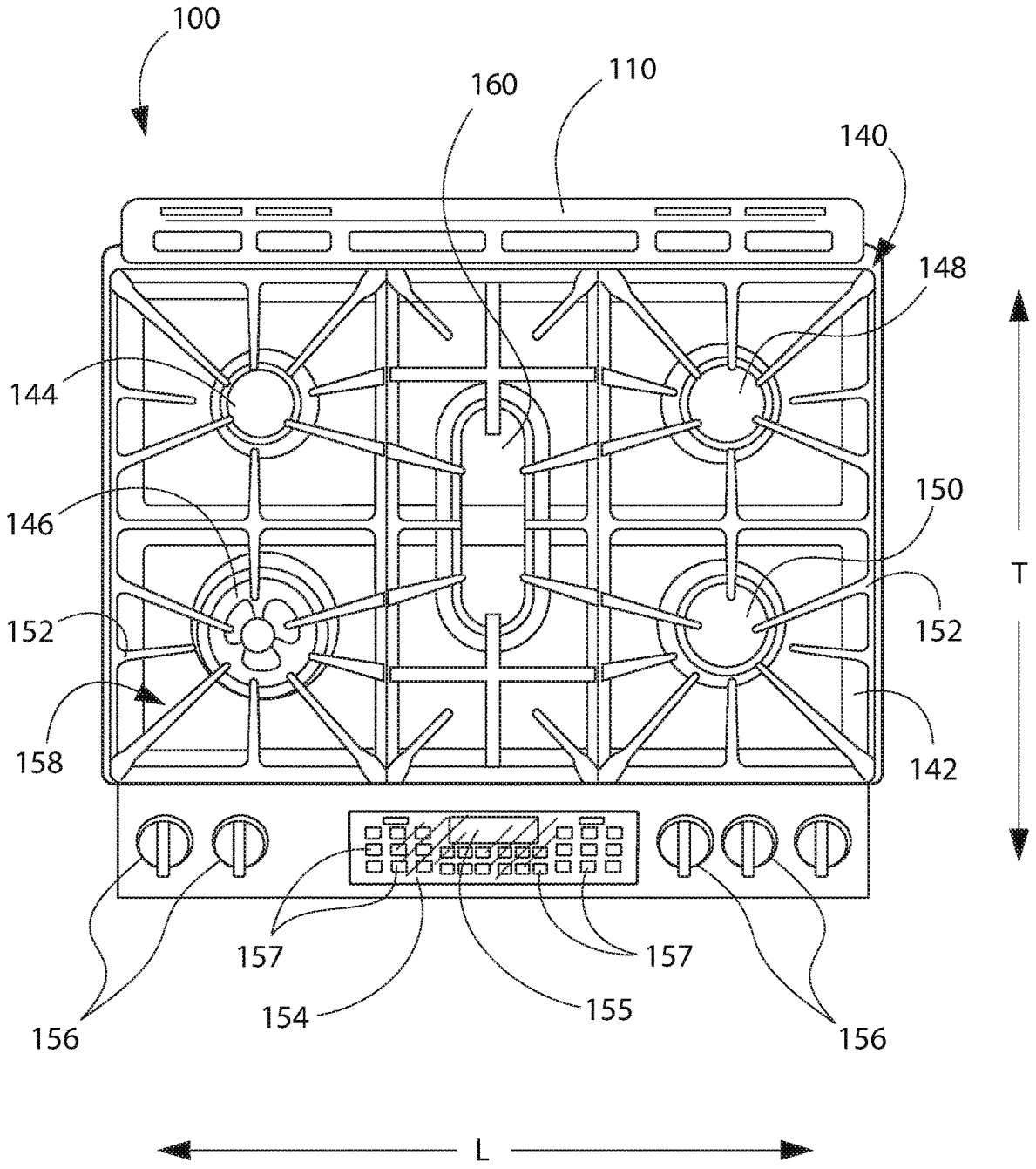
FIG. 2 provides a top, plan view of the example range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable cooktop appliance, e.g., a single oven range appliance or a standalone cooktop appliance. Thus, the example embodiment shown in FIG. 1 is not intended to limit the present subject matter to any particular cooking chamber configuration or arrangement (or even the presence of a cooking chamber at all, e.g., as in the case of a standalone cooktop appliance).

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 2, burner assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. The user interface panel 154 may also include one or more inputs 157, such as buttons or a touch pad, for selecting or adjusting operation of the range appliance 100. User interface panel 154 may also be provided with one or more graphical display devices 155 that deliver certain information to the user such as e.g., whether a particular burner assembly is activated and/or the temperature at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device 155, designed to provide operational feedback to a user.

Figure 3:
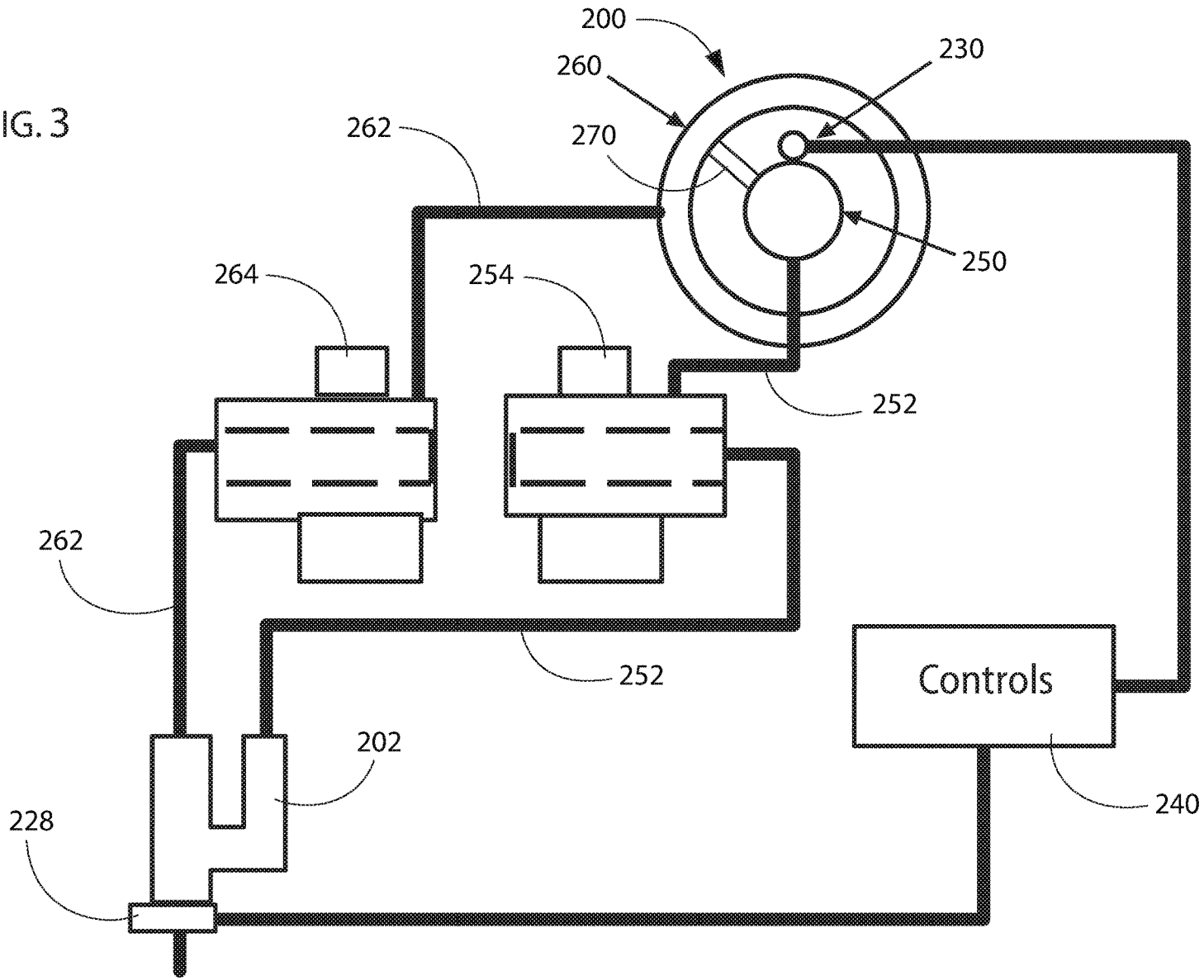
FIG. 3 provides a schematic view of certain components of the example range appliance of FIG. 1.

As shown in FIG. 3, one or more of the burner assemblies 144, 146, 148, 150 may be a multi-ring burner 200, in certain exemplary embodiments. Thus, burner 200 includes a first ring and a second ring, e.g., an inner burner ring 250 and an outer burner ring 260. In the example embodiment illustrated in FIG. 3, the multi-ring burner 200 includes two rings by way of example only, embodiments of the present disclosure may also include more than two rings, e.g., one or more additional rings between the inner and outer rings 250 and 260 and/or outside of the outer ring 260. The inner and outer burner rings 250, 260 may be concentrically positioned, e.g., such that outer burner ring 260 extends around inner burner ring 250. As those of ordinary skill in the art will recognize, the inner burner ring 250 generally includes a fuel chamber and a plurality of flame ports, while the outer burner ring 260 similarly includes a fuel chamber and a plurality of flame ports. Fuel chambers and fuel ports of gas burners are generally understood by those of ordinary skill in the art and, as such, are not illustrated or described in further detail herein for the sake of brevity and clarity. As may be seen in FIG. 3, the inner burner ring 250 and the outer burner ring 260 may be radially spaced apart from each other.

The multi-ring burner 200 also includes a carryover duct 270. Carryover duct 270 extends between inner burner ring 250 and outer burner ring 260. Carryover duct 270 is configured for assisting with transferring flames between inner burner ring 250 and outer burner ring 260. Thus, fuel at a first ring may be ignited with an igniter 230, and flames at the first ring may ignite fuel within crossover duct 270 that in turn ignites fuel at the second ring. For example, as illustrated in FIG. 3, the igniter 230 may be in operative communication with the inner burner ring 250 to ignite fuel therein, and flames may transfer through the carryover duct 270 from the inner burner ring 250 to the outer burner ring 260, i.e., the first ring may be the inner ring 250 and the second ring may be the outer ring 260. In other embodiments, the igniter 230 may be in operative communication with the outer burner ring 260, such that the outer burner ring 260 may be the first ring and the inner burner ring 250 may be the second ring. Carryover duct 270 may also include or define ports, e.g., at a top portion of carryover duct 270.

The multi-ring burner 200 may be operable by a manual dual gas valve 202. The manual dual gas valve 202 may be connected to one of the controls, e.g., knobs, 156, and an ignition switch 228 may also be coupled with the manual dual gas valve 202 and the knob 156. The ignition switch 228 may be operatively coupled to a controller 240, e.g., whereby turning the knob to ON opens the manual dual gas valve 202 and causes the ignition switch 228 to send a signal to controller 240 which then causes electrode 230 to spark, igniting fuel in the inner ring 250 of the multi-ring burner 200. The manual dual gas valve 202 includes two outputs which each provide a flow of gaseous fuel to a corresponding one of the rings 250 or 260. For example, as illustrated in FIG. 3, a first output of the manual dual gas valve 202 is connected to an inner ring gas supply line 252 to supply gas to the inner ring 250 and a second output of the manual dual gas valve 202 is connected to an outer ring gas supply line 262 to supply gas to the outer ring 260. Electronic gas valves, e.g., inner ring gas valve 254 and outer ring gas valve 264, are provided in-line with each supply line 252 and 262, such that the flow of gas to each ring 250 and 260 may be independently controlled.

The controller 240 regulates various components of range appliance 100. Controller 240 is in operative communication with various components of range appliance 100, such as user interface 154, including the inputs 157 and display 155 thereon, control valves 254 and 264, and/or igniter 230. Thus, controller 240 may adjust one or both control valves 254 and 264 in order to regulate the flow of gaseous fuel to the rings 250 and 260 of the multi-ring burner 200. Signals may be routed between controller 240 and the various operational components of range appliance 100. Thus, controller 240 can selectively activate and operate these various components. Various components of range appliance 100 are communicatively coupled with controller 240 via one or more communication lines, such as, e.g., signal lines, shared communication busses, or wirelessly.

For example, the controller 240 may send a signal to the igniter 230 which causes the igniter 230 to emit a spark, thereby igniting any fuel which is present in the corresponding first ring of the burner 200, such as the inner ring 250 in the illustrated embodiment, or the outer ring 260 in other embodiments, and the controller 240 may also receive a signal, e.g., based on current, from the igniter 230 whereby the controller 240 can determine a flame status of the first ring of the multi-ring burner 200.

Controller 240 includes memory and one or more processing devices such as microprocessors, CPUs or the like, such as general or special purpose microprocessors operable to execute programming instructions or micro-control code associated with operation of range appliance 100. The memory can be non-transitory and represent random access memory such as DRAM, or read only memory such as ROM or FLASH. The processor executes programming instructions stored in the memory. The memory can be a separate component from the processor or can be included onboard within the processor. The memory can store information accessible by the processor(s), including instructions that can be executed by the processor(s). For example, the instructions can be software or any set of instructions that when executed by the processor(s), cause the processor(s) to perform operations. For the embodiment depicted, the instructions may include a software package configured to operate the system to, e.g., execute the exemplary methods described below. Alternatively, controller 240 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

As mentioned, embodiments of the present disclosure may include methods of operating a cooktop appliance and/or a multi-ring gas burner thereof, such as the cooktop appliance 100 and/or one or more multi-ring burners 200 as described above. Also, in some embodiments, the controller 240 of the cooktop appliance 100 may be configured, e.g., programmed, and/or operable to perform such methods. Accordingly, reference numerals used above for the exemplary components of the cooktop appliance are also provided in the following description of the method embodiment for context of one particular example implementation of the described methods, but are not limiting and the described methods may also be implemented with different appliances, e.g., stand-along cooktops, etc.

Figure 4:
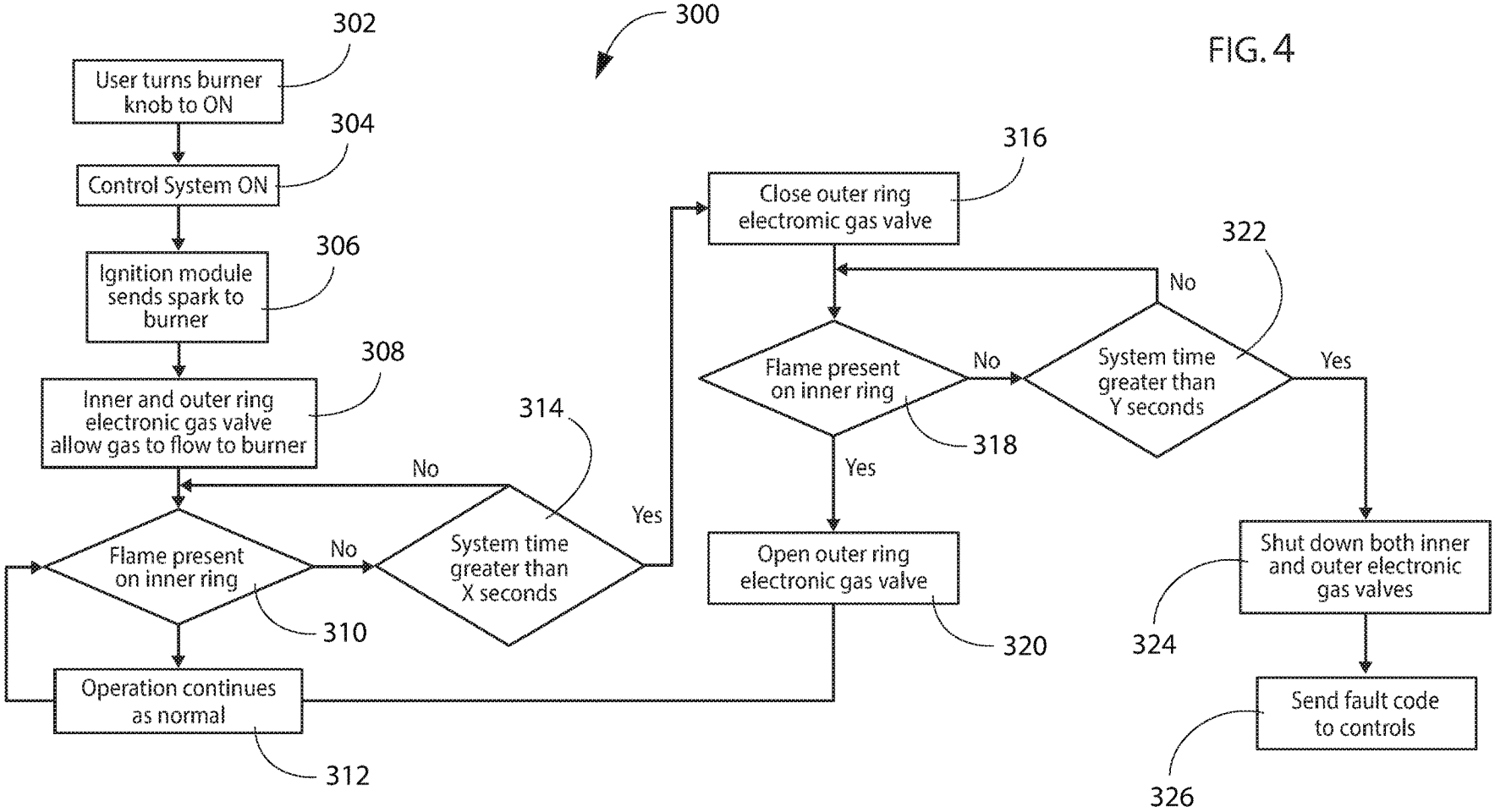
FIG. 4 provides a flow chart illustrating an exemplary method of operating a cooktop appliance according to one or more example embodiments of the present subject matter.

For example, a method 300 of operating a multi-ring gas burner is illustrated in FIG. 4. Operation of the multi-ring gas burner commences when, as shown at 302, a user turns a burner knob 156 to an "ON" position. When the knob 156 is turned ON, the control system, e.g., controller 240, is also activated, e.g., turned ON as shown at 304. The method 300 may further include a step 306 of sending a spark to the burner 200, e.g., the ignition module 228 may send a spark to a first ring, which is the inner ring 250 in the illustrated example but may instead be the outer burner ring 260 in other embodiments, of the multi-ring burner 200, such as via the electrode 230. In at least some embodiments, the method 300 may also include opening both the inner ring electronic gas valve 254 and the outer ring electronic gas valve 264 at step 308. Sparking the igniter 230 at step 306 will be done before the inner ring electronic gas valve 254 and the outer ring electronic gas valve 264 are opened at step 308, such that the igniter 230 is sparked before there is gas present in the first ring, e.g., the inner ring 250.

After supplying fuel and ignition (e.g., a spark) to the first ring of the burner 200, e.g., the inner ring 250, the method 300 may then include a step 310 of determining a flame status of the first ring, e.g., determining a presence or absence of flame at the first ring. In various embodiments, the method 300 then includes adjusting a position of the second gas valve, e.g., the electronic gas valve 264 connected to the outer ring 260 in the example embodiment illustrated by FIG. 4, based on the determined flame status of the inner ring 250, e.g., closing the valve 264 when the determined flame status is an absence of flame at the inner ring 250 and/or opening the valve 264 when the determined flame status is a presence of flame at the inner ring 250. As mentioned above, in additional embodiments, the outer ring 260 may be the first ring and the outer ring electronic gas valve 264 may be the first valve, where the inner ring 250 and inner ring electronic gas valve 254 will be the second ring and second valve, respectively.

In some embodiments, when the determined flame status of the inner ring 250 is a presence of flame, e.g., when flame is detected at the inner ring 250 during step 310, the method 300 may then proceed to a step 312 where operation continues as normal, e.g., the electronic gas valves 254 and 264 remain open and continue to provide fuel to both rings 250 and 260 of the burner 200. Additionally, normal operation at step 312 may also include continued monitoring of the flame status at the inner ring 250 and/or repeated iterations of step 310 such as determining a second flame status, a third flame status, etc. In such embodiments, e.g., where method 300 includes the initial step 308 of opening the gas valve 254 and 264 and/or where the gas valves 254 and 264 allow gas to flow to each ring of the burner at step 308, normal operation comprises the valves 254 and 264 remaining open. In alternative embodiments, gas flow may be provided to only the inner ring 250 at step 308, and the method 300 may further include adjusting the electronic gas valve 264 connected to the outer ring 250 based on the determined flame status by opening the electronic gas valve 264 connected to the outer ring 250 when a presence of flame at the inner ring 250 is determined or detected.

Referring again to FIG. 4, in some embodiments, when the determined flame status at step 310 is an absence of flame at the inner ring, e.g., where the result at step 310 is "No," as illustrated in FIG. 4, the method 300 may include allowing a period of time to elapse, e.g., waiting for X seconds, and/or determining whether a system time, e.g., the time since activation at step 302, is greater than X seconds, as illustrated at step 314 in FIG. 4. In various embodiments, X seconds may include a system time of between about two seconds and about six seconds, such as between about three seconds and about five seconds, such as about four seconds. When the system time is less than or equal to X seconds, e.g., is not greater than X seconds, at step 314, the method 300 may return to step 310 and continue to monitor flame status of the inner ring 250 and/or determine a second flame status of the inner ring after the period of time (X seconds). After allowing the period of time to elapse, e.g., when the system time is greater than X seconds, the method 300 may then proceed to step 316 of adjusting the position of the electronic gas valve 264 connected to the outer ring 260 based on the determined second flame status, e.g., closing the outer ring gas valve 264 when flame is not present at the inner ring 250 and the system time is greater than X seconds, as illustrated at step 316 in FIG. 4.

Further, when the determined second flame status is an absence of flame at the inner ring, e.g., when the method 300 returns to step 310 after step 314 and a flame is still not present at the inner ring 250 after the first period of time (e.g., X seconds) has elapsed, and when adjusting the position of the electronic gas valve 264 connected to the outer ring 260 based on the determined second flame status comprises closing the electronic gas valve 264, e.g., at step 316, the method 300 may then allow a second period of time, e.g., Y seconds, as illustrated at 322, to elapse after closing the electronic gas valve 264 connected to the outer ring 260. Where the second period of time comes after the first period of time, Y seconds will be greater than X seconds, e.g., if the system or method includes waiting ten seconds after the first period of time and the first period of time corresponds to X seconds being five seconds, then Y seconds would be fifteen seconds, e.g., the second period of time would correspond to a total system time of about fifteen seconds. Thus, in various embodiments, Y seconds may include a system time of between about ten seconds and about thirty seconds, such as between about fifteen seconds and about twenty-five seconds, such as about twenty seconds. During the second period of time and after closing the valve 264 at step 316, the method 300 may continue to monitor flame status at the inner ring 250 and/or may include determining a third flame status, at step 318. When a flame is detected at the inner ring 250 (e.g., when 318 leads to "Yes," as illustrated) during the second period of time, e.g., while the system time is less than or equal to Y seconds, the method 300 may then include a step 320 of opening the outer ring gas valve 264. After opening the outer ring gas valve 264 at 320, the operation continues as normal at step 312, as described above.

When the second period of time has elapsed, e.g., when the system time is greater than Y seconds at step 322 in FIG. 4, and when the determined third flame status is an absence of flame at the inner ring 250, e.g., when flame is not present at step 318 in FIG. 4, the method 300 may then include closing the electronic gas valve 254 connected to the inner ring 250 of the multi-ring burner 200, e.g., shutting down both the inner ring electronic gas valve 254 and the outer ring electronic gas valve 264, as illustrated at step 324 in FIG. 4.

Additionally, the method 300 may then include a step 326 of transmitting a fault code when the determined third flame status is an absence of flame at the inner ring 250. For example, in embodiments where the controller 240 of the cooktop appliance 100 is configured to perform the exemplary method steps, the step 326 may include generating a fault code and providing a user alert on the display 155 of the cooktop appliance 100 when the determined third flame status is an absence of flame at the inner ring. For example, the user alert on the display may include the text of the fault code, additional or other text corresponding to the fault code, and/or a color code corresponding to the fault code, among other possible examples of the user alert.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a multi-ring gas burner, comprising:

sending a spark to a first ring of the multi-ring burner;

determining a flame status of the first ring, wherein the determined flame status is an absence of flame at the first ring;

allowing a period of time to elapse;

determining a second flame status of the first ring after the period of time, wherein the determined second flame status is an absence of flame at the first ring;

adjusting a position of an electronic gas valve connected to a second ring of the multi-ring gas burner based on the determined second flame status of the first ring, by closing the electronic gas valve connected to the second ring;

allowing a second period of time to elapse after closing the electronic gas valve connected to the second ring;

determining a third flame status of the first ring after the second period of time; and opening the electronic gas valve connected to the second ring when the determined third flame status is a presence of flame at the first ring.

2. The method of claim 1, further comprising closing an electronic gas valve connected to the first ring of the multi-ring burner when the determined third flame status is an absence of flame at the first ring.

3. The method of claim 2, further comprising transmitting a fault code when the determined third flame status is an absence of flame at the first ring.

4. The method of claim 1, wherein the period of time is about four seconds.

5. The method of claim 1, wherein the second period of time is about twenty seconds.

6. A cooktop appliance, comprising:

a multi-ring gas burner comprising a first ring, a second ring, an igniter in operative communication with the first ring to ignite fuel in the first ring and thereby initiate combustion in the first ring, the igniter further operable to detect a presence or an absence of combustion in the first ring, and a carryover duct extending from the first ring to the second ring, whereby combustion products generated in the first ring ignite fuel from the second ring in the carryover duct whereupon combustion products travel through the carryover duct to initiate combustion in the second ring;

a first electronic gas valve connected to the first ring;

a second electronic gas valve connected to the second ring; and a controller in operative communication with the igniter, the first electronic gas valve, and the second electronic gas valve, the controller configured for:

sending a spark to the first ring of the multi-ring burner via the igniter;

determining a flame status of the first ring based on a signal from the igniter, wherein the determined flame status is an absence of flame at the first ring;

allowing a period of time to elapse after determining the flame status of the first ring;

determining a second flame status of the first ring after the period of time, wherein the determined second flame status is an absence of flame at the first ring;

adjusting a position of the second electronic gas valve connected to the second ring of the multi-ring gas burner based on the determined second flame status of the first ring by closing the second electronic gas valve connected to the second ring;

allowing a second period of time to elapse after closing the second electronic gas valve connected to the second ring;

determining a third flame status of the first ring after the second period of time; and opening the second electronic gas valve connected to the second ring when the determined third flame status is a presence of flame at the first ring.

7. The cooktop appliance of claim 6, wherein controller is further configured for closing the first electronic gas valve connected to the first ring of the multi-ring burner when the determined third flame status is an absence of flame at the first ring.

8. The cooktop appliance of claim 7, wherein controller is further configured for generating a fault code and providing a user alert on a display of the cooktop appliance when the determined third flame status is an absence of flame at the first ring.

9. The cooktop appliance of claim 6, wherein the period of time is about four seconds.

10. The cooktop appliance of claim 6, wherein the second period of time is about twenty seconds.

* * * * *